US007053349B2

(12) United States Patent
Jeong

(10) Patent No.: US 7,053,349 B2
(45) Date of Patent: May 30, 2006

(54) MICROWAVE OVEN

(75) Inventor: Sang Jin Jeong, Yongin-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/110,829

(22) Filed: Apr. 21, 2005

(65) Prior Publication Data

US 2005/0274719 A1 Dec. 15, 2005

(30) Foreign Application Priority Data

Jun. 14, 2004 (KR) ..... 10-2004-0043649

(51) Int. Cl.
*H05B 6/78* (2006.01)
*H05B 6/68* (2006.01)

(52) U.S. Cl. ..... 219/752; 219/753; 219/754

(58) Field of Classification Search ..... 219/752, 219/753, 754, 755, 762–763; 126/338; 108/20, 108/139, 140–141
See application file for complete search history.

(56) References Cited

U.S. PATENT DOCUMENTS 5,315,086 A 5/1994 Pressouyre
5,672,291 A * 9/1997 Han ..... 219/753
5,804,800 A * 9/1998 Lee et al. ..... 219/753
5,831,253 A * 11/1998 Han et al. ..... 219/708
6,512,213 B1 * 1/2003 Choi ..... 219/754
2005/0016998 A1 * 1/2005 Choi ..... 219/754

FOREIGN PATENT DOCUMENTS

JP 52-113444 A 8/1977
JP 55-10433 A 8/1977
JP 09-053830 A 2/1997
KR 20-1991-0001043 U 1/1991
KR 20-0248985 Y1 11/2001
KR 20-0248986 Y1 11/2001

* cited by examiner

*Primary Examiner*—Quang Van
(74) *Attorney, Agent, or Firm*—Sughrue Mion, PLLC

(57) ABSTRACT

A microwave oven according to the present invention includes a body, an inner case provided in the body and partitioning the interior of the body into an inner space defining a cooking chamber and an outer space defining an electric component chamber, and a magnetron equipped in the electric component chamber for irradiating microwaves into the cooking chamber. The microwave oven also includes a tray mounted on the bottom of the cooking chamber, and a driving apparatus for driving the tray in one mode selected from a first mode in which the tray travels only in a rotational motion, a second mode in which the tray travels only in a linearly reciprocating motion, and a third mode in which the tray travels both in the rotational motion and in the linearly reciprocating motion at the same time.

16 Claims, 8 Drawing Sheets

MICROWAVE OVEN

CROSS-REFERENCE TO RELATED APPLICATION

This application claims the benefit of Korean Patent Application No. 2004-43649, filed on Jun. 14, 2004 in the Korean Intellectual Property Office, the disclosure of which is incorporated herein by reference.

BACKGROUND OF THE INVENTION

1. Field of the Invention

The present invention relates to a microwave oven and, more particularly, to a microwave oven, which has a tray mounted on the bottom of a cooking chamber for laying foods thereon to travel in a rotational motion and in linearly reciprocating motion, so that the food can be uniformly cooked.

2. Description of the Related Art

Generally, a microwave oven is an appliance to cook or heat food, using a frictional heat, which is produced between moisture molecules of the food due to repeated changes in the molecular arrangement of moisture contained in the food by an irradiation of microwaves generated from a magnetron of the microwave oven into a cooking chamber.

Such a conventional microwave oven has a body defining an outer appearance of the microwave oven. The body is provided with a rectangular parallelepiped inner case therein, thereby partitioning the interior of the body into a cooking chamber at the inside of the inner case and an electric component chamber at the outside of the inner case.

The cooking chamber has a tray mounted on the bottom of the cooking chamber, which can be rotated, with food to be cooked laid thereon, by a motor provided under the bottom of the cooking chamber. The electric component chamber is equipped with the magnetron for generating the microwaves and then irradiating them into the cooking chamber, a high-voltage transformer and a high-voltage condenser for supplying a high voltage to the magnetron, etc.

With this configuration, when the microwave oven operates, the microwaves generated by the magnetron are irradiated into the cooking chamber, thereby cooking the food rotating along with the tray.

However, since the tray of the conventional microwave oven is rotated about a fixed point at a predetermined position on the bottom of the cooking chamber, there is a limitation on uniform cooking for the food.

Accordingly, in order to solve the problems mentioned above, a microwave oven, disclosed in Korean Patent Registration No. 10-0423993 issued to the applicant of the present invention, has a tray, which can travel in a rotational motion and in a linearly reciprocating motion, so that the food laid on the tray may be uniformly cooked.

The microwave oven of Korean Patent Registration No. 10-0423993 is provided with a slot hole-shaped penetrating hole formed on the bottom of a cooking chamber; a shaft, provided at a lower portion of the tray such that the shaft is extended through the penetrating hole to the outside of the cooking chamber, and having a pinion formed on an outer surface of the shaft; and a guide member fixed to the lower portion of the cooking chamber and formed with a rack engaged with the pinion. The microwave oven also includes a first link, having a first end swingably connected to an end of the shaft and a second end, and a second link, having a first end swingably connected to the second end of the first link and a second end fixed to a rotational shaft of a motor provided at the lower portion of the cooking chamber.

With this configuration, when the second link is rotated along with the rotational shaft of the motor in one direction, the pinion is rotated along the rack in the clockwise direction or in the counterclockwise direction, and the first link is pulled into the motor side or pushed to the opposite side thereof, thereby forcing the shaft to rotate and linearly reciprocate in the penetrating hole. Accordingly, the tray rotates along with the shaft on the bottom of the cooking chamber while linearly reciprocating, and thus, the food laid on the tray can be uniformly cooked through the movement of the tray.

However, although the tray of the microwave oven, disclosed in Korean Patent Registration No. 10-0423993, can rotate and linearly reciprocate in the cooking chamber, since the tray is driven by one motor, the rotational motion and the linearly reciprocating motion of the tray are always carried out simultaneously. As a result, when the rotational motion of the tray is hindered due to a large volume of the food laid on the tray, the linearly reciprocating motion of the tray becomes impossible, and on the other hand, when cooking a great amount of food at the same time with the food laid on the bottom of the cooking chamber as well as on the tray, the linearly reciprocating motion of the tray is hindered, and the rotational motion of the tray becomes thus impossible. Accordingly, in such cases mentioned above, the food cannot be uniformly cooked in the microwave oven.

SUMMARY OF THE INVENTION

The present invention has been made in view of the problems involved with the above conventional microwave oven, and an aspect of the invention is to provide a microwave oven having a tray, which can be driven in various ways in a cooking chamber, so that food on the tray can be uniformly cooked.

Additional aspects and/or advantages of the invention will be set forth in part in the description which follows and, in part, will be apparent from the description, or may be learned by practice of the invention.

In accordance with one exemplary aspect, the present invention provides a microwave oven, comprising: a body; an inner case, provided in the body, which partitions the interior of the body into an inner space defining a cooking chamber and an outer space defining an electric component chamber; a magnetron, equipped in the electric component chamber, which irradiates microwaves into the cooking chamber; a tray mounted on the bottom of the cooking chamber; and a driving apparatus which drives the tray in a mode selected from a first mode in which the tray travels only in a rotational motion, a second mode in which the tray travels only in a linearly reciprocating motion, and a third mode in which the tray travels both in the rotational motion and in the linearly reciprocating motion at the same time.

The driving apparatus may comprise a movable motor having a rotational shaft coupled to the tray to force the tray to travel in the rotational motion; a fixed motor; a link member, linking the fixed motor to the moveable motor, which translates a rotational force of the fixed motor into a linearly reciprocating motion and transmits the linearly reciprocating motion to the movable motor to force the movable motor and the tray to travel in the linearly reciprocating motion; and a controller which controls operations of the movable motor and the fixed motor.

The controller may independently control the operations of the movable motor and the fixed motor.

The controller may independently control rotational velocities of the movable motor and the fixed motor.

The movable motor and the fixed motor may be provided at an outer portion of the cooking chamber, and the driving apparatus may further comprise: a slot-shaped guide hole formed through the inner case at the bottom of the cooking chamber in a direction of the linearly reciprocating motion of the tray such that the rotational shaft of the movable motor may pass through the guide hole; a sliding member mounted on the movable motor, which slides in the lengthwise direction of the guide hole when the fixed motor is being driven; and a supporting member attached to an outer surface of the inner case at the bottom of the cooking chamber to slidably support the sliding member.

The driving apparatus may further comprise a choke member disposed around an outer periphery of the sliding member which prevents microwaves transmitted through the guide hole from leaking to the outside of the sliding member.

The choke member may be formed with a plurality of choke grooves, an upper portion of each of which opens along the outer periphery of the sliding member.

The sliding member may slide within a limited range such that the guide hole remains within a perimeter of the choke member.

The movable motor may be joined to a lower portion of the sliding member, and the sliding member may be formed with a penetrating hole such that the rotational shaft of the movable motor may be extended to an upper portion of the sliding member.

The supporting member may comprise an attaching portion, provided between an outer surface of the inner case below the guide hole and the sliding member, and attached to the outer surface of the inner case, and rails provided at each side of the attaching portion such that the rails slidably support the sliding member, wherein the attaching portion has a communication hole therein corresponding to the guide hole such that the rotational shaft of the moving motor may be extended into the cooking chamber through the communication hole and the guide hole.

The attaching portion may be welded to the outer surface of the inner case, thus preventing microwaves from leaking into a gap between the inner case and the attaching portion, and the driving apparatus may further comprise a choke disposed around an outer periphery of the sliding member, which prevents microwaves transmitted through the guide hole from leaking to the outside of the sliding member.

The sliding member may slide within a limited range such that the communication hole remains within a perimeter of the choke member, and the attaching portion may have a length longer than that of the sliding member, thus preventing the sliding member from deviating from the attaching portion.

The movable motor may be coupled to a lower portion of the sliding member, and the sliding member may have a penetrating hole therein, such that the rotational shaft of the movable motor may extend into the cooking chamber through the penetrating hole, the communication hole, and the guide hole.

The link member may comprise a first link, comprising a first end swingably connected to one side of the sliding member, and a second end, and a second link, comprising a first end swingably connected to the second end of the first link and a second end fixed to the rotational shaft of the fixed motor to rotate along with the rotational shaft of the fixed motor.

The microwave oven may further comprise a link connector having a first end attached to one side of the sliding member, and a second end extending to the fixed motor and swingably connected to the first link.

In accordance with another aspect, the present invention provides a microwave oven, comprising: a cooking chamber, a tray equipped within the cooking chamber; and a driving apparatus which drives the tray in one mode selected from a first mode in which the tray travels only in a rotational motion, a second mode in which the tray travels only in a linearly reciprocating motion, and a third mode in which the tray travels both in the rotational motion and in the linearly reciprocating motion at the same time, wherein the driving apparatus comprises a movable motor having a rotational shaft coupled to the tray to force the tray to travel in the rotational motion; and a fixed motor, linked to one side of the movable motor, which supplies a driving force to force the movable motor and the tray to travel in the linearly reciprocating motion.

BRIEF DESCRIPTION OF THE DRAWINGS

These and/or other aspects and advantages of the invention will become apparent and more readily appreciated from the following description of the exemplary embodiments, taken in conjunction with the accompanying drawings of which.

DETAILED DESCRIPTION OF THE ILLUSTRATIVE, NON-LIMITING EMBODIMENTS

Exemplary embodiments of the present invention will now be described in detail with reference to the annexed drawings.

Figure 1:
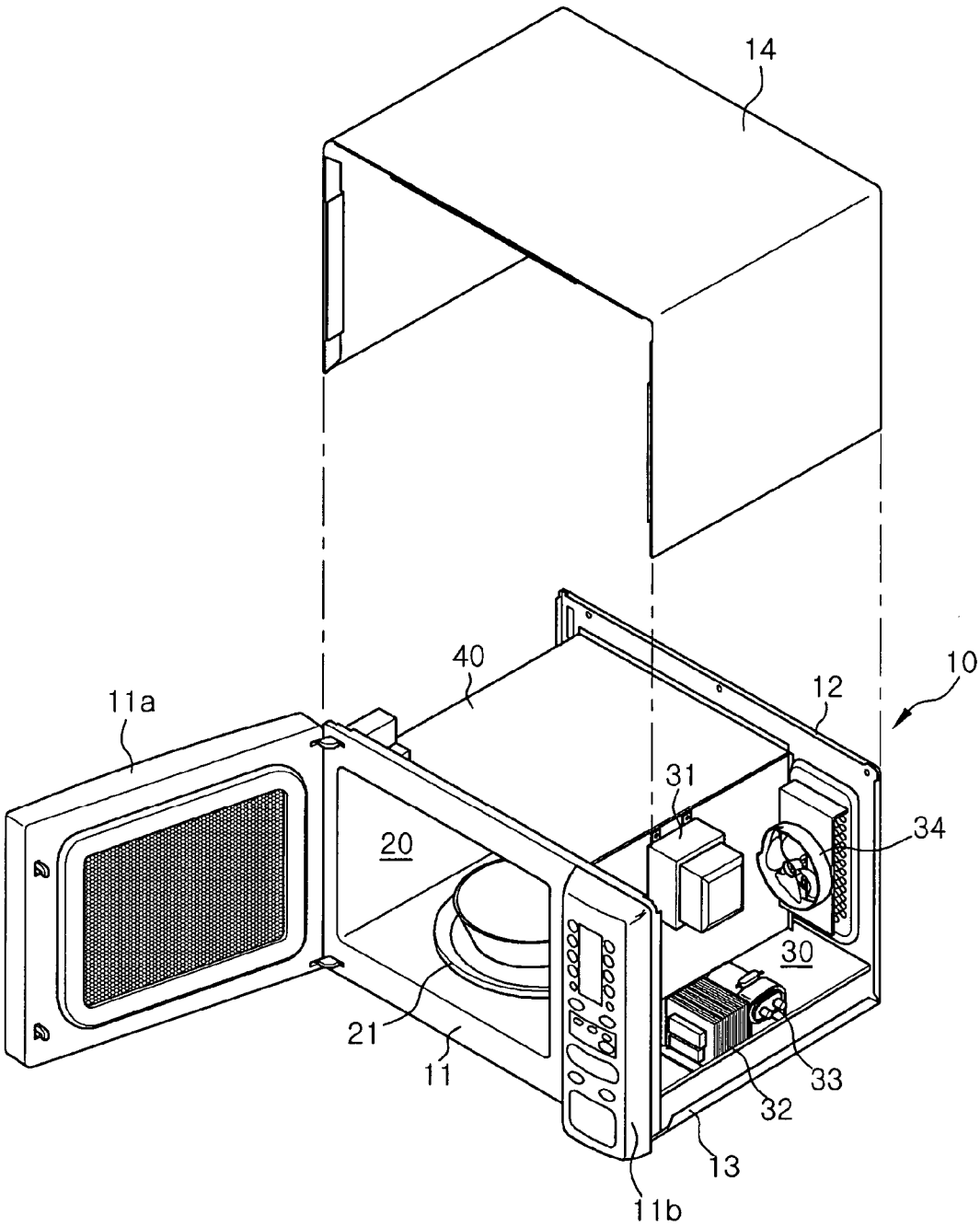
FIG. 1 is a perspective view illustrating an entire configuration of an exemplary microwave oven according to the present invention, a part of which is exploded.
Figure 2:
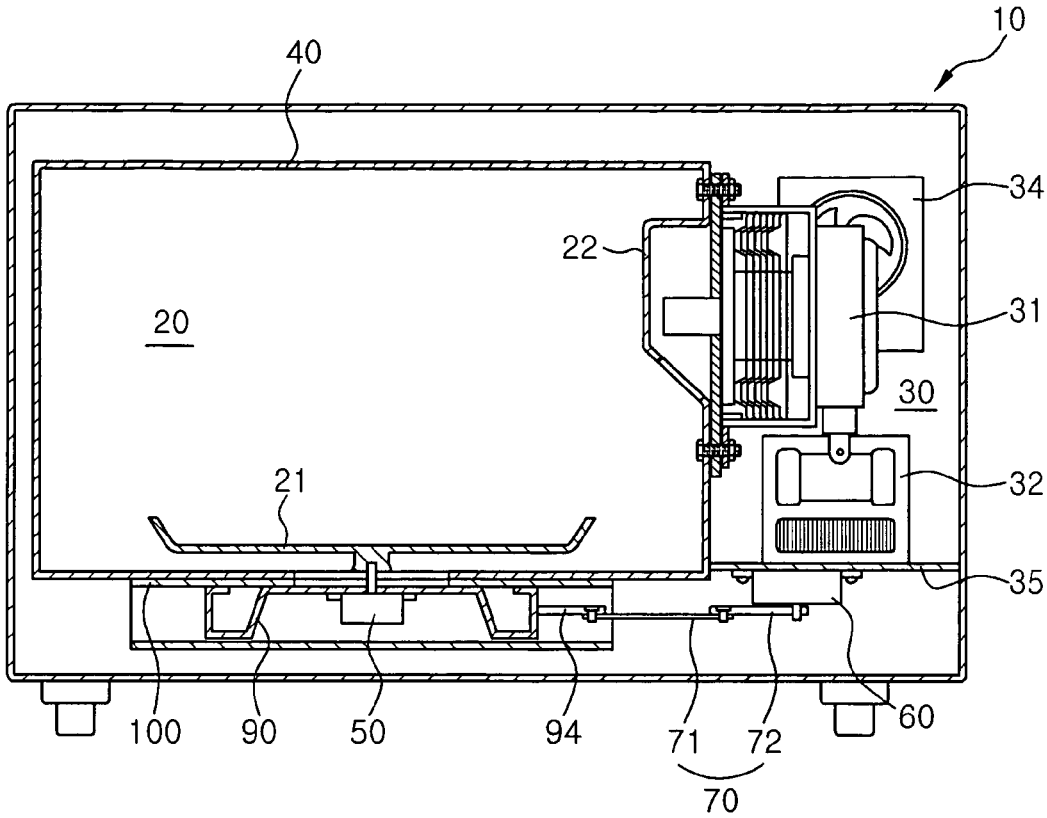
FIG. 2 is a cross-sectional view illustrating an entire configuration of an exemplary microwave oven according to the present invention.

Referring to FIGS. 1 and 2, a microwave oven according to the present invention includes a body 10 defining an outer appearance of the microwave oven. The body 10 of the microwave oven is provided with front and rear plates 11 and 12 constituting front and rear surfaces, respectively, a bottom plate 13 constituting a bottom surface, and a cover 14 constituting both sides and an top surface.

The body 10 is provided with a rectangular parallelepiped inner case 40 opened at the front side thereof and partitioning the interior of the body into an inner space for defining a cooking chamber 20 and an outer space for defining an electric component chamber 30 in the body 10. The front plate 11 of the body 10 is provided with a door 11*a*, hinged thereto for opening or closing the cooking chamber 20, and an operating panel 11*b* having a plurality of operating buttons for operating an overall operation of the microwave oven provided thereon.

The electric component chamber 30 at the right side of the cooking chamber 20 is equipped with a magnetron 31 to generate microwaves supplied into the cooking chamber 20, a high-voltage transformer 32 and a high-voltage condenser 33 for supplying a high voltage to the magnetron 16, a cooling fan 34 for cooling respective electric components in the electric component chamber 30, and the like. The cooking chamber 20 is equipped at an inner portion of the inner case with a tray 21 mounted on the bottom of the cooking chamber 20 to lay foods to cook thereon, a waveguide 22 to guide the microwaves irradiated from the magnetron 31 into the cooking chamber 20, and the like.

With this configuration, when driving the microwave oven with the food laid on the tray 21, the microwaves are irradiated into the cooking chamber 20, and the food in the cooking chamber 20 is cooked by a frictional heat, which is produced between moisture molecules of the food due to a repeated change in the molecular arrangement of moisture contained in the food by an irradiation of the microwaves into the cooking chamber.

The microwave oven of the present invention further comprises a driving apparatus to drive the tray 21 in one mode selected from a first mode forcing the tray 21 to travel only in a rotational motion, a second mode forcing the tray 21 to travel only in a linearly reciprocating motion, and a third mode forcing the tray 21 to travel both in the rotational motion and in the linearly reciprocating motion at the same time.

When one of the rotational motion and the linearly reciprocating motion of the tray cannot be preformed, the microwave oven having such a configuration described above can force the tray 21 to travel not only both in the rotational motion and the linearly reciprocating motion at the same time, but also in one of the rotational motion and the linearly reciprocating motion, thereby allowing the tray 21 to be driven in more various directions, so that the food on the tray can be more uniformly heated and cooked by the microwaves irradiated into the cooking chamber 20.

Figure 3:
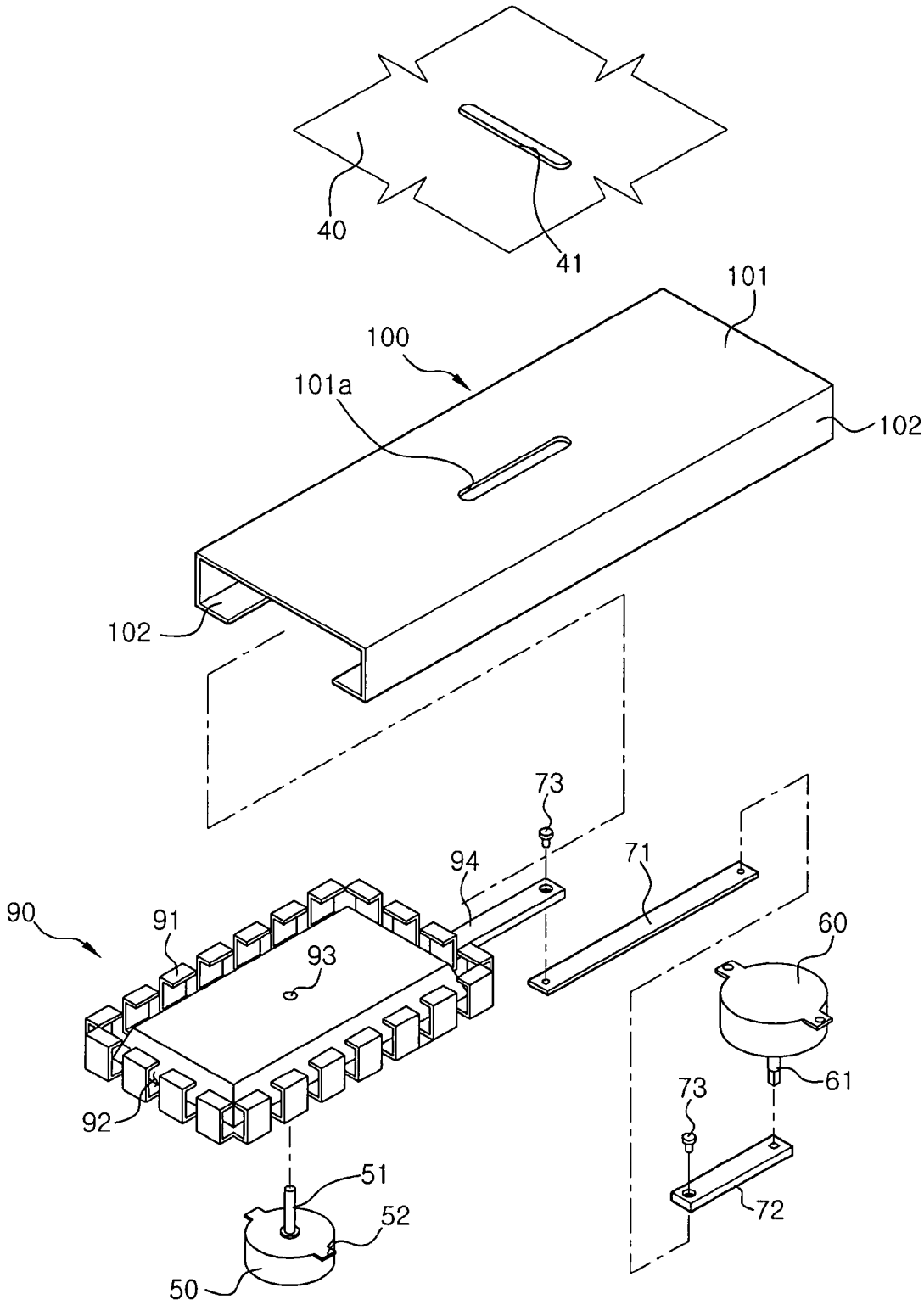
FIG. 3 is an exploded perspective view illustrating a driving apparatus of an exemplary microwave oven according to the present invention.
Figure 4:
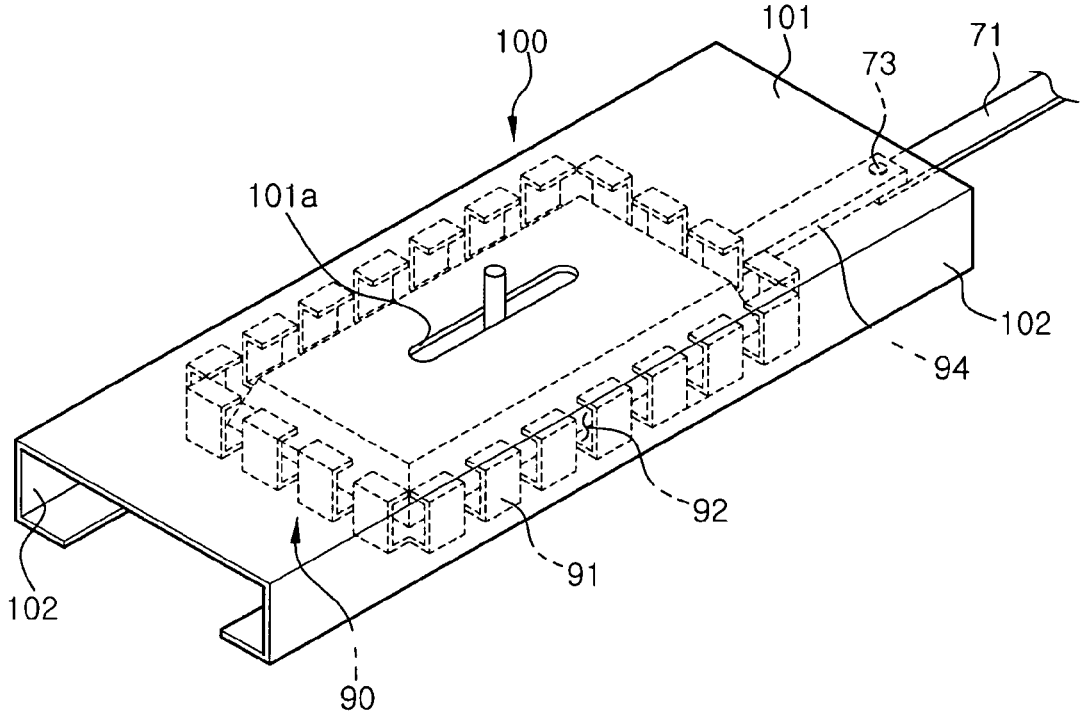
FIG. 4 is a perspective view illustrating a state wherein a sliding member of the driving apparatus is coupled to a supporting member in an exemplary microwave oven according to the present invention.
Figure 5:
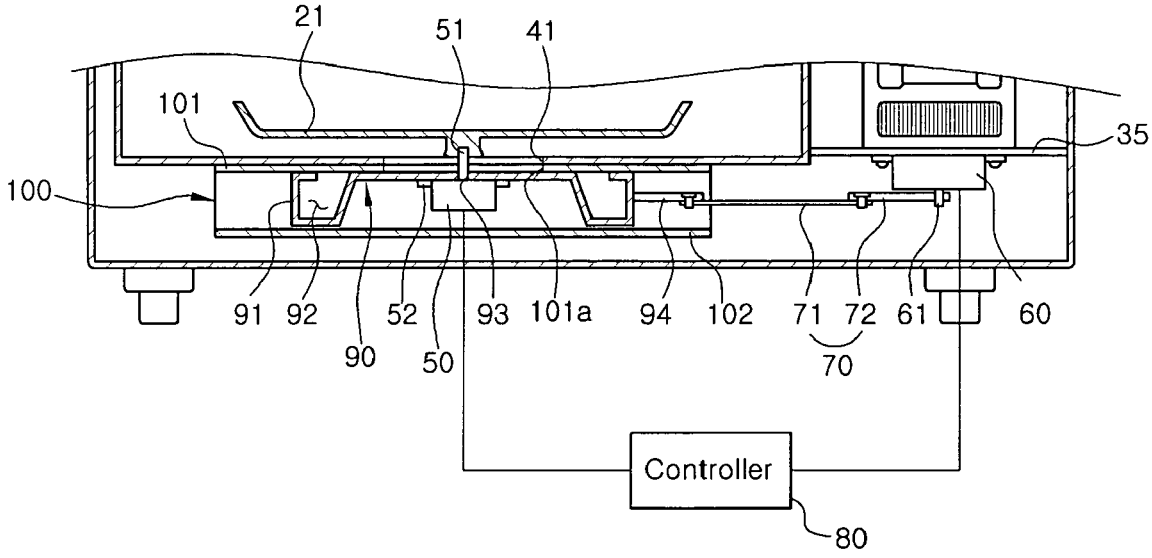
FIG. 5 is a cross sectional view illustrating driving apparatus of an exemplary microwave oven according to the present invention.

Referring to FIGS. 3 through 5, the driving apparatus comprises a movable motor 50 traveling in the linearly reciprocating motion along with the tray 21 in a state that a rotational shaft 51 of the movable motor 50 is coupled to the tray 21 at the center of a lower surface of the tray 21 to allow the tray 21 to travel in the rotational motion; a fixed motor 60 linked to one side of the movable motor 50; a link member 70 for translating a rotational force of the fixed motor 60 into a linearly reciprocating motion and transmitting that motion to the movable motor 50 to allow the movable motor 50 to travel in the linearly reciprocating motion; and a controller 80 for controlling an operation of the movable motor 50 and the fixed motor 60.

The movable motor 50 is provided at an outer surface of the inner case 40 under the bottom of the cooking chamber 20, and the inner case 40 is formed with a slot hole-shaped guide hole 41 at the bottom of the cooking chamber 20 in a direction of the linearly reciprocating motion of the tray 21 such that the rotational shaft 51 of the movable motor 50 can pass therethrough and be coupled to the center of the lower surface of the tray 21.

The driving apparatus further comprises a sliding member 90, which is mounted on the movable motor 50 and is able to slide left and right in a lengthwise direction of the guide hole 41, and a supporting member 100 attached to the outer surface of the inner case 40 to slidably support the sliding member 90. The supporting member 100 comprises an attaching portion 101, attached to the outer surface of the inner case 40, and rails 102 provided at both ends of the attaching portion 101 such that the rails 102 slidably support the sliding member 100.

The attaching portion 101 is provided between the sliding member 90 and the outer surface of the inner case 40 formed with the guide hole 41 on the bottom of the cooking chamber 20, and is attached to the outer surface of the inner case 40 covering the guide hole 41. The rails 102 are formed in the supporting member 100 by bending the sides of the supporting member 100 to extend downward from both front and rear ends of the attaching portion 101 and then bending the sides of the supporting member 100 inwardly. The attaching portion 101 is formed at the center of the supporting member with a communication hole 101*a*, corresponding to the guide hole 41 such that the rotational shaft 51 of the movable motor 50 mounted on the sliding member 90 may be extended into the cooking chamber 20 through the communication hole and the guide hole 41.

Since the microwaves irradiating into the cooking chamber 20 can be leaked through the guide hole 41 formed on the inner case, the supporting member 100 and the sliding member 90 are formed with a structure to prevent the microwaves from being leaked. First, the attaching portion 101 of the supporting member 100 is welded to the outer surface of the inner case 40, thereby preventing the microwaves transmitted to the outside of the cooking chamber 20 through the guide hole 41 from being leaked through a gap between the inner case 40 and the attaching portion 101. Furthermore, the driving apparatus further comprises a choke member 91 around an outer periphery of the sliding member 90 to prevent the microwaves transmitted to a gap between the attaching member 101 of the supporting member 100 and the sliding member 90 through the guide hole 41 and the communication hole 101*a* from being leaked to the outside of the sliding member 90.

The choke member 91 has a choke structure generally provided at the rear of a door of the microwave oven to prevent the microwaves in the cooking chamber from being leaked through the door to the outside, the structure of which is formed through a plurality of choke grooves 92 having an upper portion of each of the choke grooves opened along the outer periphery of the sliding member 90.

Furthermore, in a case where the communication hole 101*a* is deviated from the choke member 91 or the choke member 91 is deviated from the attaching portion 101 of the supporting member 100 due to a sliding movement of the sliding member 90, the microwaves can be leaked to the outside of the sliding member 90. Accordingly, the sliding member 90 slides in a range such that the communication hole 101*a* is not deviated to the outside of the choke member 91, and the attaching portion 101 has a length longer than that of the sliding member 90 to prevent the sliding member 90 from being deviated from the attaching portion 101. As such, with the choke member 91 provided in the sliding member 90, the microwaves irradiated into the cooking chamber 20 are prevented from being leaked to the outside of the sliding member 90.

The movable motor 50 is welded at an upper welding portion 52 thereof to a lower surface of the sliding member 90 such that the movable motor 50 is joined to the sliding member 90. Accordingly, when the welding portion 52 of the movable motor 50 is welded to the lower surface of the sliding member 90, the movable motor 50 is joined to the sliding member 90. If the movable motor 50 is joined to an upper portion of the sliding member 90, the microwaves transmitted from the gap between the supporting member 100 and the sliding member 90 can damage the movable motor 50. Thus, when the welding portion 52 of the movable motor 50 is welded to the lower surface of the sliding member 90, the movable motor 50 is prevented from being broken by the microwaves transmitted from the gap between the supporting member 100 and the sliding member 90. Here, the sliding member 90 is formed at the center thereof with a penetrating hole 93 such that the rotational shaft 51 of the movable motor 50 may be extended into the cooking chamber 20 through the penetrating hole, the communication hole 101 of the supporting member 100, and the guide hole 41 of the inner case 40.

Meanwhile, even if the attaching portion 101 of the supporting member 100 were not provided or had other shapes different from that described above, whereby the sliding member 90 slides in a state that the sliding member 90 directly supports the inner case 40 around the guide hole 41 of the inner case 40, if the sliding member 90 is adapted to slide within a range that the guide hole 41 is not deviated from the choke member 91 of the sliding member 90, the choke member 91 prevents the microwaves transmitted from the gap between the inner case 40 and the sliding member 90 through the guide hole 41 from being leaked to the outside of the sliding member 90.

Furthermore, the fixed motor 60, which supplies a driving force to move the movable motor 50 in the linearly reciprocating motion, is provided between the outer surface of the inner case 40 at the right side of the cooking chamber 20 and the body 10, is spaced a predetermined distance from the sliding member 90, and is equipped on at least one support plate 35 extending parallely from the bottom of the inner case 40 to support the high-voltage transformer 32 and the high-voltage condenser 33. The fixed motor 60 is fixed to the supporting plate 35 by a screw, or is otherwise attached, such that a rotational shaft 61 of the fixed motor 60 faces the bottom of the microwave oven. The link member is provided between the rotational shaft 61 of the fixed motor 60 and the sliding member equipped with the moveable motor 50.

The link member 70 comprises a first link 71 and a second link 72. The first link 71 has a first end swingably connected to one side of the sliding member 90. The second link 72 has a first end swingably connected to a second end of the first link 71 and a second end fixed to the rotational shaft 61 of the fixed motor 60 to rotate along with the rotational shaft 61 of the fixed motor 60. The sliding member 90 is provided with a link connector 94 extending from the right side of the choke member 91 to the fixed motor 60 such that the one end of the first link 71 can be swingably connected to the link connector 94. Reference numeral 73 denotes connecting pins for connecting the first and second links, and for connecting the first link 71 and the link connector 94.

Accordingly, in the microwave oven having such a driving apparatus, when the movable motor 50 is driven to rotate the rotational shaft 51 of the movable motor 50, the tray coupled to the rotational shaft 51 of the movable motor 50 travels in the rotational motion, and when the fixed motor 50 is driven to rotate the rotational shaft 61 of the fixed motor 60, the second link 72, connected to the rotational shaft 61 of the fixed motor 60, rotates to cause the sliding member 90, connected to the second link 72 through the first link 71, to slide to the left and right sides while causing the movable motor 50 to slide, whereby the tray 21 coupled travels in the linearly reciprocating motion to the left and right sides in the lengthwise direction of the guide hole 41.

The controller 80 for controlling the operations of the movable motor 50 and the fixed motor 60 can independently control the operations of the movable motor 50 and the fixed motor 60. That is, since the operations of the movable motor 50 and the fixed motor 60 can be independently controlled by the controller 80, the tray 21 can be driven in one mode selected from a first mode in which the tray travels only in the rotational motion, a second mode in which the tray travels only in the linearly reciprocating motion, and a third mode in which the tray travels both in the rotational motion and in the linearly reciprocating motion at the same time.

Specifically, when only the fixed motor 60 is driven with the movable motor 50 in a stationary state through the controller 80, the tray 21 is driven in the first mode wherein the tray 21 is rotated in place without traveling in the linearly reciprocating motion, and on the contrary, when only the movable motor 50 is driven with the fixed motor 60 in the stationary state, the rotational shaft 51 of the movable motor 50 is not rotated while the rotational shaft 61 of the fixed motor 60 is rotated, so that the tray 21 is driven in the second mode wherein the tray 21 travels only in the linearly reciprocating motion to the right and left sides. Furthermore, when the movable motor 50 and the fixed motor 60 are simultaneously driven through the controller 80, the tray 21 is driven in the third mode wherein the tray 21 travels in the rotational motion and in the linearly reciprocating motion at the same time by the rotational shafts 51 and 61 of the movable motor 50 and the fixed motor 60, respectively.

Furthermore, the controller 80 may independently control rotational velocities of the movable motor 50 and the fixed motor 60. This is attributed to the fact that when the tray 21 is driven in the first or second mode, a rotational velocity or a linearly reciprocating velocity of the tray 21 can be controlled, and simultaneously, when the tray 21 is driven in the third mode, rotational ratios of the movable motor 50 and the fixed motor 60 can be changed, so that the microwaves irradiated with different irradiation amounts according to a position in the cooking chamber 20 can uniformly irradiate the food laid on the tray.

Hereinafter, operations and advantageous effects of the microwave oven according to the invention will be described.

Figure 6:
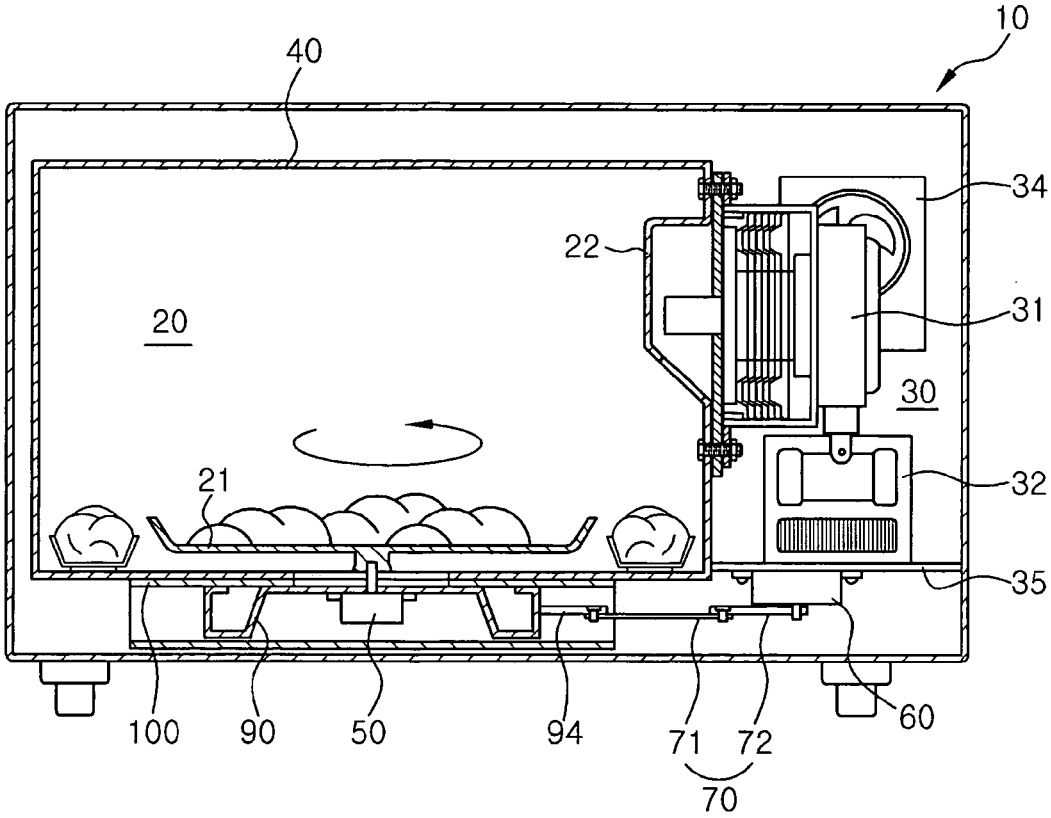
FIG. 6 is a sectional view illustrating a state in which a tray is driven in a first mode.

First, referring to FIG. 6, there is illustrated a case wherein the tray 21 is driven in the first mode by the driving apparatus. In this case, with operations of the controller 80, the fixed motor 60 is in a stationary state and the movable motor 60 is driven, so that the tray 21 rotates in place without traveling in the linearly reciprocating motion. Accordingly, in a case where the linearly reciprocating motion of the tray 21 is hindered due to a great amount of food laid on the bottom of the cooking chamber 20 at either side of the tray 21 as well as on the tray 21, if the tray 21 is driven in the first mode as mentioned above, at least the food on the tray 21 can be more uniformly cooked by the rotational motion of the tray 21.

Figure 7:
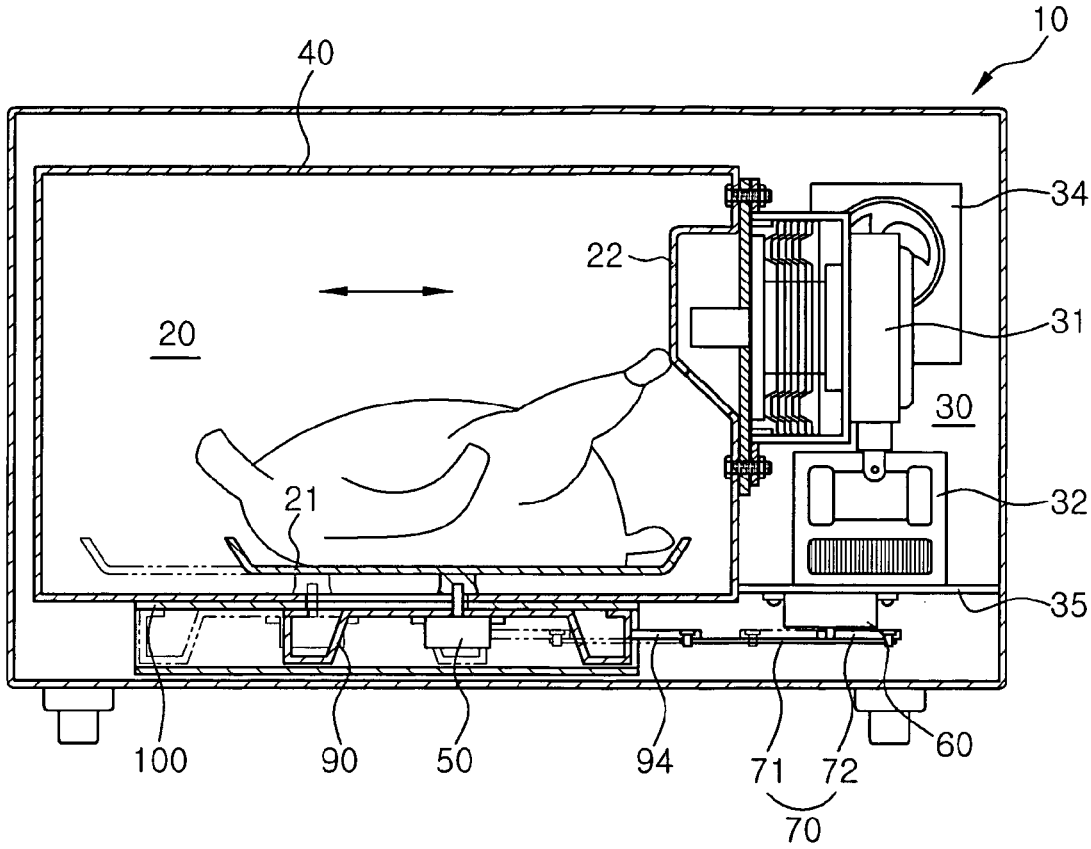
FIG. 7 is a sectional view illustrating a state in which a tray is driven in a second mode.

Next, referring to FIG. 7, there is illustrated a case wherein the tray 21 is driven in the second mode by the driving apparatus. In this case, with the operations of the controller 80, the fixed motor 60 is driven and the movable motor 60 is in the stationary state. Thus, the rotational shaft 61 of the fixed motor 60 starts to rotate, forcing the second link 72 connected to the rotational shaft 61 of the fixed motor 60 to rotate, and then the sliding member 90, connected to the second link 72 through the first link 71, slides left and right, sliding the movable motor 50, whereby the tray, coupled to the rotational shaft 51 of the movable motor 50, travels left and right in the linearly reciprocating motion in the lengthwise direction of the guide hole 41. Accordingly, as shown in FIG. 7, in a case where the rotational motion of the tray 21 is hindered due to a large volume of the food laid on the tray 21, the second mode of the tray 21 is appropriate to uniformly cook the food of the large volume on the tray 21.

Figure 8:
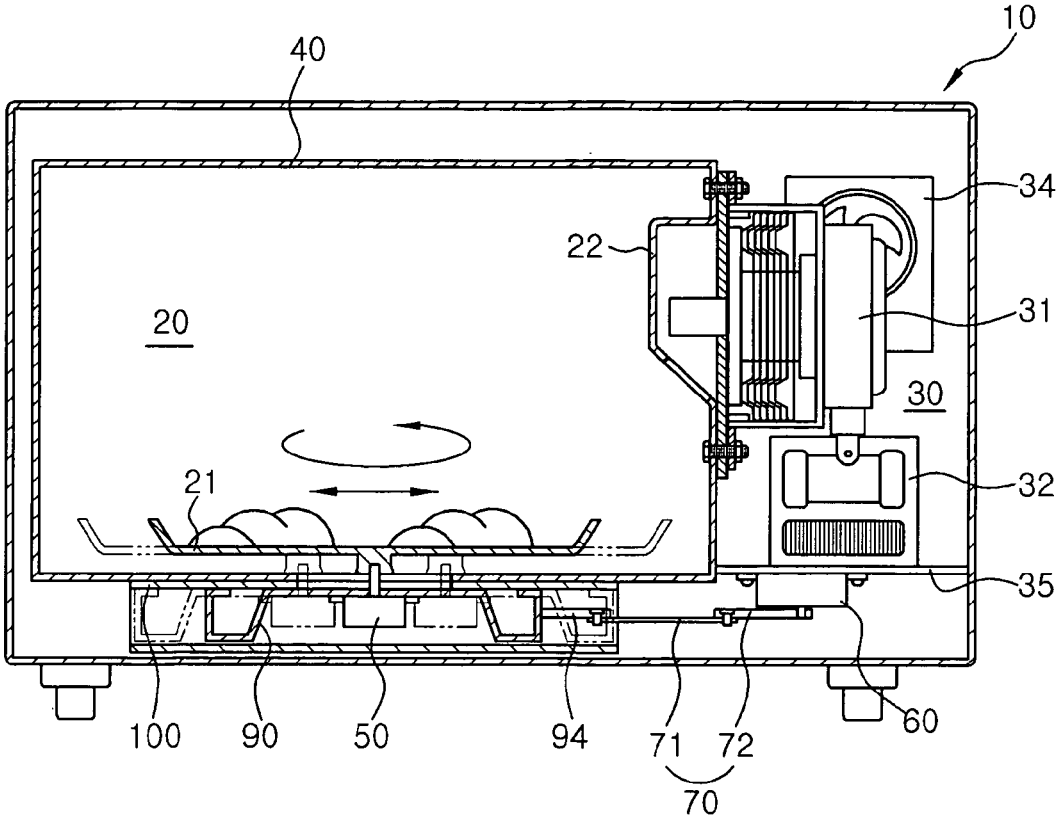
FIG. 8 is a sectional view illustrating a state in which a tray is driven in a third mode.

Additionally, as shown in FIG. 8, in a case where a size or an amount of the food is appropriate not to interfere with the rotational and the linearly reciprocating motions of the tray 21, if the tray 21 is driven in the third mode by the driving apparatus, the tray 21 travels left and right in the linearly reciprocating motion while being rotated by the force of the rotational shafts 51 and 61 of the movable motor 50 and the fixed motor 60 rotated at the same time, so that the food on the tray 21 can be more uniformly cooked in this mode than in the first and second modes.

As apparent from the above description, in the microwave oven consistent with the present invention, there is an advantageous effect in that the tray can be driven in various ways by the driving apparatus for driving the tray in one mode selected from the first mode forcing the tray to travel only in a rotational motion, the second mode forcing the tray to travel only in a linearly reciprocating motion, and the third mode forcing the tray to travel both in the rotational motion and in the linearly reciprocating motion at the same time, so that the food on the tray can be more uniformly cooked.

Although exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising:

a body;

an inner case, provided in the body, which partitions an interior of the body into an inner space defining a cooking chamber and an outer space defining an electric component chamber;

a magnetron, equipped in the electric component chamber, which irradiates microwaves into the cooking chamber;

a tray mounted on a bottom of the cooking chamber; and a driving apparatus which drives the tray in a mode selected from:

a first mode in which the tray travels only in a rotational motion, a second mode in which the tray travels only in a lateral linearly reciprocating motion, and a third mode in which the tray travels both in the rotational motion and in the lateral linearly reciprocating motion at the same time.

2. The microwave oven according to claim 1, wherein the driving apparatus comprises a movable motor having a rotational shaft coupled to the tray to force the tray to travel in the rotational motion;

a fixed motor;

a link member, linking the fixed motor to the moveable motor, which translates a rotational force of the fixed motor into a lateral linearly reciprocating motion and transmits the lateral linearly reciprocating motion to the movable motor to force the movable motor and the tray to travel in the lateral linearly reciprocating motion; and a controller which controls operations of the movable motor and the fixed motor.

3. The microwave oven according to claim 2, wherein the controller independently controls the operations of the movable motor and the fixed motor.

4. The microwave oven according to claim 2, wherein the controller independently controls rotational velocities of the movable motor and the fixed motor.

5. A microwave oven, comprising:

a body;

an inner case, provided in the body, which partitions an interior of the body into an inner space defining a cooking chamber and an outer space defining an electric component chamber;

a magnetron, equipped in the electric component chamber, which irradiates microwaves into the cooking chamber;

a tray mounted on a bottom of the cooking chamber; and a driving apparatus which drives the tray in a mode selected from:

a first mode in which the tray travels only in a rotational motion, a second mode in which the tray travels only in a linearly reciprocating motion, and a third mode in which the tray travels both in the rotational motion and in the linearly reciprocating motion at the same time;

wherein the driving apparatus comprises:

a movable motor having a rotational shaft coupled to the tray to force the tray to travel in the rotational motion;

a fixed motor;

a link member, linking the fixed motor to the moveable motor, which translates a rotational force of the fixed motor into a linearly reciprocating motion and transmits the linearly reciprocating motion to the movable motor to force the movable motor and the tray to travel in the linearly reciprocating motion; and a controller which controls operations of the movable motor and the fixed motor;

wherein the movable motor and the fixed motor are provided at an outer portion of the cooking chamber; and wherein the driving apparatus further comprises:

a slot-shaped guide hole formed through the inner case at the bottom of the cooking chamber in a direction of the linearly reciprocating motion of the tray such that the rotational shaft of the movable motor passes through the guide hole;

a sliding member, mounted on the movable motor, which slides in the lengthwise direction of the guide hole when the fixed motor is being driven; and a supporting member attached to an outer surface of the inner case at the bottom of the cooking chamber to slidably support the sliding member.

6. The microwave oven according to claim 5, wherein the driving apparatus further comprises a choke member disposed around an outer periphery of the sliding member which prevents microwaves transmitted through the guide hole from leaking to the outside of the sliding member.

7. The microwave oven according to claim 6, wherein the choke member comprises a plurality of choke grooves, an upper portion of each of which opens along the outer periphery of the sliding member.

8. The microwave oven according to claim 6, wherein the sliding member slides within a limited range such that the guide hole remains within a perimeter of the choke member.

9. The microwave oven according to claim 6, wherein the movable motor is joined to a lower portion of the sliding member, and the sliding member is formed with a penetrating hole such that the rotational shaft of the movable motor extends to an upper portion of the sliding member.

10. The microwave oven according to claim 5, wherein the supporting member comprises:

an attaching portion, provided between an outer surface of the inner case below the guide hole and the sliding member, and attached to the outer surface of the inner case, and rails provided at each side of the attaching portion such that the rails slidably support the sliding member, wherein the attaching portion has a communication hole therein corresponding to the guide hole such that the rotational shaft of the moving motor extends into the cooking chamber through the communication hole and the guide hole.

11. The microwave oven according to claim 10, wherein the attaching portion is welded to the outer surface of the inner case, thus preventing microwaves from leaking into a gap between the inner case and the attaching portion, and wherein the driving apparatus further comprises a choke disposed around an outer periphery of the sliding member, which prevents microwaves transmitted through the guide hole from leaking to the outside of the sliding member.

12. The microwave oven according to claim 11, wherein the sliding member slides within a limited range such that the communication hole remains within a perimeter of the choke member, and the attaching portion has a length longer than that of the sliding member, thus preventing the sliding member from deviating from the attaching portion.

13. The microwave oven according to claim 11, wherein the movable motor is coupled to a lower portion of the sliding member, and wherein the sliding member has a penetrating hole therein, such that the rotational shaft of the movable motor extends into the cooking chamber through the penetrating hole, the communication hole, and the guide hole.

14. The microwave oven according to claim 5, wherein the link member comprises a first link, comprising a first end swingably connected to one side of the sliding member, and a second end, and a second link, comprising a first end swingably connected to the second end of the first link and a second end fixed to the rotational shaft of the fixed motor, thus rotating along with the rotational shaft of the fixed motor.

15. The microwave oven according to claim 14, further comprising a link connector having a first end attached to one side of the sliding member and a second end extending to the fixed motor and swingably connected to the first link.

16. A microwave oven, comprising:

a cooking chamber;

a tray equipped within the cooking chamber; and a driving apparatus which drives the tray in a mode selected from:

a first mode in which the tray travels only in a rotational motion, a second mode in which the tray travels only in a lateral linearly reciprocating motion, and a third mode in which the tray travels both in the rotational motion and in the lateral linearly reciprocating motion at the same time;

wherein the driving apparatus comprises:

a movable motor having a rotational shaft coupled to the tray to force the tray to travel in the rotational motion; and a fixed motor, linked to one side of the movable motor, which supplies a driving force to force the movable motor and the tray to travel in the lateral linearly reciprocating motion.

* * * * *